United States Patent [19]

Dobson

[11] 4,318,528

[45] Mar. 9, 1982

[54] MOUNTING DEVICE FOR PLATES

[76] Inventor: Charles E. Dobson, Rambles, Knote Park, Almondsbury, Bristol, England

[21] Appl. No.: 84,575

[22] Filed: Oct. 15, 1979

[30] Foreign Application Priority Data

Oct. 19, 1978 [GB] United Kingdom ..... 41233/78

[51] Int. Cl.[3] ..... G09F 7/18

[52] U.S. Cl. ..... 248/475 R; 248/221.4; 248/DIG. 9

[58] Field of Search ..... 248/221.4, 223.4, 475 R, 248/DIG. 9; 52/98; 40/605

[56] References Cited

U.S. PATENT DOCUMENTS

| | | | |
|---|---|---|---|
| 799,092 | 9/1905 | Rosenfeld | 248/DIG. 9 |
| 887,272 | 5/1908 | Robinson | 248/DIG. 9 |
| 2,916,159 | 12/1959 | O'Neill | 248/DIG. 9 |
| 3,289,340 | 12/1966 | Edwards | 40/143 |
| 4,059,914 | 11/1977 | Dobson | 52/473 X |
| 4,194,637 | 3/1980 | Edson | 248/221.4 X |

FOREIGN PATENT DOCUMENTS

| | | | |
|---|---|---|---|
| 1095649 | 12/1960 | Fed. Rep. of Germany . | |
| 2404882 | 4/1979 | France . | |
| 65694 | 7/1913 | Switzerland | 248/263 |
| 1359150 | 7/1974 | United Kingdom | 248/223.4 |
| 1532995 | 11/1978 | United Kingdom . | |

*Primary Examiner*—William H. Schultz

*Attorney, Agent, or Firm*—Cushman, Darby & Cushman

[57] ABSTRACT

A mounting device for shallow channel section plates has an elongate base strip (10) from which project a series of heads (12), each head comprising a pair of outwardly convex elements (14). The plate can be clipped resiliently onto any two mutually outwardly convex elements (14). Grooves (24) are provided between adjacent heads (12) so that the base strip can be broken to suit the overall width of the plate or plates being mounted. End spacer elements (28) are provided for accurately positioning two strips end-to-end. The spacer element (28) can be broken away if not required. One or more strips (10) may be slidably carried in a channel member (32) mounted to a support. Alternatively the strips (10) can be screwed directly to a support through slightly elongate holes (26) between each pair of elements (14).

4 Claims, 2 Drawing Figures

MOUNTING DEVICE FOR PLATES

FIELD OF THE INVENTION

This invention relates to mounting plates, for example sign plates, to a support such as a wall. More particularly it is concerned with plates which are of shallow channel cross-section, having rearwardly directed flanges with mutually convergent portions on their facing surfaces.

BACKGROUND TO THE INVENTION

In my U.K. Pat. No. 1,532,995 I described a mounting device for such plates in the form of an elongate base strip having a plurality of heads projecting therefrom uniformly spaced along the strip, each head comprising a spaced pair of elements having mutually divergent portions on their surfaces remote from each other, whereby plates, whose flanges are spaced apart by a multiple of the unit centre-to-centre spacing of adjacent heads, can be resiliently push-fitted onto the strip which extends at right angles to direction of extension of the plates. The present invention provides a development of this device which is more versatile and more easily employed.

SUMMARY OF THE INVENTION

The present invention provides a mounting device for use in mounting to a support surface a plate which is provided with rearwardly directed flanges having mutually convergent portions on their facing surfaces, the device comprising an elongate base strip for securing to a said support and having a plurality of heads projecting therefrom uniformly spaced apart along the strip, each head comprising a spaced pair of elements having mutually divergent portions on their surfaces remote from each other, whereby a said plate can be mounted to the device by resiliently pushing the plate flanges over two said elements on the strip, the mutually convergent portions of the flanges being retained by the mutually divergent portions of the elements; characterised in that the strip has lines of weakening between adjacent heads whereby portions of the strip having one or more complete heads can be broken therefrom. Preferably the strip is provided at its ends with a spacer element, whereby when a strip end is mounted end-to-end with a broken-off portion of a strip, with the spacer element abutting the edge formed by the fracture at the line of weakening, the spacing of the adjacent heads on either side of the join is the same as the uniform spacing of the heads along a strip. The spacer element is preferably connected to the strip by a line of weakening, whereby it can be broken away when not required for spacer purposes. Preferably, an aperture is provided in the base strip between each pair of head-forming elements. The aperture is desirably elongate in the longitudinal direction of the strip. The strip preferably extends at each longitudinal side beyond the heads to provide side flanges. There may be provided a channel member into which the base strip or a broken-off part thereof is longitudinally slidable, the side flanges being retained by inturned lips at the mouth of the channel, the heads projecting through the mouth of the channel, whereby the channel can be mounted to the said support, and one or more clips each comprising a strip or a portion of a said strip are fitted into the channel to receive one or more said plates.

BRIEF DESCRIPTION OF THE DRAWINGS AND DESCRIPTION OF PREFERRED EMBODIMENTS

In order that the invention may be more clearly understood, one embodiment will now be described with reference to the accompanying drawings, wherein.

Figure 1:
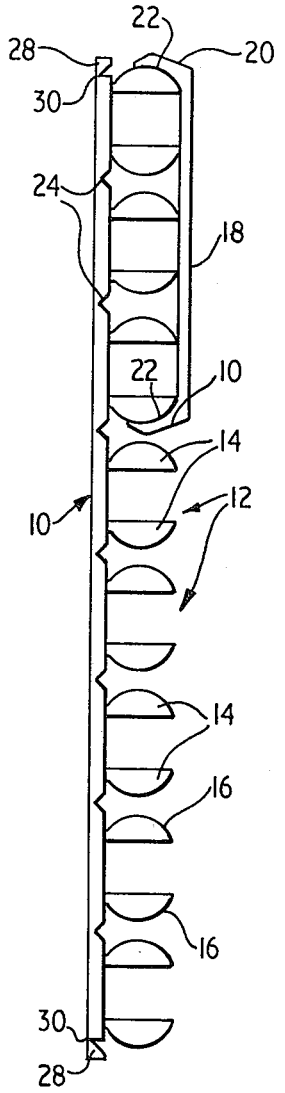
FIG. 1 shows a side view of a mounting device.

Referring to the drawings; the mounting device is injection moulded from plastics material, and comprises a generally flat base strip 10 from which project a number of heads 12 uniformly spaced apart along the strip. Each head comprises a pair of spaced elements 14, the mutually remote surfaces 16 of which are convex in cross-section. A plate 18, typically a sign plate of extruded aluminium, is of shallow channel cross-section, having rearwardly directed flanges 20, the mutually facing surfaces 22 of which are concave. The flanges 20 are spaced apart by an amount corresponding to the unit centre-to-centre spacing of the heads, or a multiple thereof. In the illustrated example, the spacing of the flanges corresponds to three times this unit spacing, so that the plate embraces three heads on the strip. The plate is mounted to the strip by resiliently pushing the flanges over the two outermost elements 14 of the set of three heads thus embraced, the concave surfaces of the flanges being retained by the convex surfaces of said elements.

The strip 10 is formed with grooves 24 between adjacent heads, which provide lines of weakening, whereby portions of the strip having one or more complete heads can be broken therefrom. In this way, the length of strip can be adjusted to suit the width of the plate, or the combined widths of the plates attached thereto. The strip has an aperture 26 between each pair of head forming elements, to receive a screw or the like for fixing the strip to a support surface. Only three or four screws will normally be necessary for fixing a strip, but an aperture is provided for each head to allow for the fact that the strip can be broken into smaller portions. The apertures are somewhat elongate in the longitudinal direction of the strip to accommodate slight errors in the precise positioning of the screws. It will be appreciated that the precise positioning of the strips in this direction is frequently very important, whereas the precise positioning of the strips laterally is less important since the plates 18 are of uniform cross-section.

At the ends of the strip there are provided spacer elements 28 which are joined to the strip through the narrower neck 30 so that the spacer elements can be broken off if not required. The purpose of the spacer elements can be seen from FIG. 2, where the end of one strip 10A is mounted end-to-end with a broken-off portion 10B of another strip, so that the spacer element 28 of the strip 10A abuts an edge of the strip portion 10B formed at the line of weakening where the unwanted part of strip 10B was broken away. The spacer element 28 ensures that the adjacent heads 12A, 12B of the respective strips have the same spacing as the other heads in the strips. Likewise, if 10B were a complete strip, then the correct spacing of the adjacent heads 12A, 12B would be ensured by the mutual abutment of their respective spacer elements. Where two or more strips or portions of strips are joined end-to-end in this way, it is preferably arranged so that the top and bottom edges of the combination are provided by the original strip ends, from which the spacer elements 28 can be broken away so that these ends are substantially concealed behind the plates 18.

Figure 2:
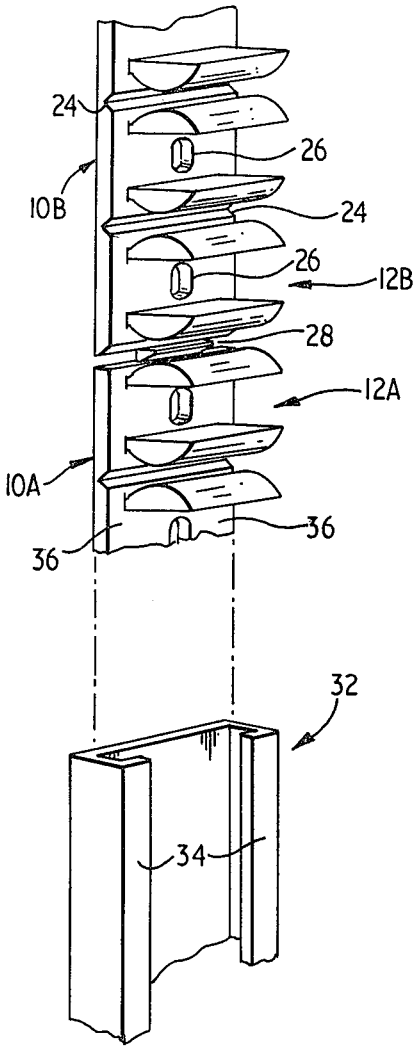
FIG. 2 shows a perspective view of part of two such devices mounted end-to-end, and the use of a mounting channel in combination with a mounting device of the invention.

In an alternative method of securing the clips to a support surface, as shown in FIG. 2, a channel member 32, for example of metal, is provided with inturned lips 34 at the mouth. As will be seen from FIG. 2, the strips 10 project laterally a short distance beyond the heads 12, providing lateral flanges 36 the strips can be slid lengthwise into the channel 32, the flanges 36 being retained behind the lips 34. The bottom end of the channel can be crimped somewhat to prevent the strips from falling through. By this means, a channel 32 can be mounted to the support surface using screws of the like, and an appropriate number of strips, or parts of strips, slid into the channel, the heads 12 projecting from the channel mouth to receive the plates 18. In this way, the strips do not need to be individually attached to the support surface. Alternatively, screws may be passed through apertures 26 in the strips and corresponding apertures in the channel to secure them to the support surface. In this way, the channel need not be crimped to hold the strips in it. The spacer elements still fulfil their function ensuring the correct spacing between heads of adjacent strips.

I claim:

1. A mounting device for use in mounting to a support surface a plate which is provided with rearwardly directed flanges having mutually convergent portions on their facing surfaces, the device comprising:

(i) an elongate base strip having a plurality of heads projecting therefrom uniformly spaced apart along the strip, each head comprising a spaced pair of elements having mutually divergent portions on their surfaces remote from each other, whereby a said plate can be mounted to the device by resiliently pushing the plate flanges over two said elements on the strip, the mutually convergent portions of the flanges being retained by the mutually divergent portions of the elements; the strip having lines of weakening between adjacent heads whereby portions of the strip having one or more complete heads can be broken therefrom; the strip being provided at its ends with a projecting spacer portion whereby when a strip end is mounted end-to-end with a broken-off portion of a strip, with the spacer portion abutting the edge formed by the fracture at the line of weakening, the spacing of the adjacent heads on either side of the join is the same as the uniform spacing of the heads along a strip; the strip extending at each longitudinal side beyond the heads to provide side flanges; and (ii) a channel member having mutually inturned lips, into which channel member the base strip is longitudinally slidable, the side flanges being retained by the inturned lips at the mouth of the channel, the heads projecting through the mouth of the channel;

whereby the channel can be mounted to a said support, and a plurality of strips or broken-off portions of strips can be fitted into the channel abutting edge-to-edge to receive one or more said plates.

2. A mounting device according to claim 1 wherein the portion is an element connected to the strip by a line of weakening, whereby it can be broken away when not required for spacer purposes.

3. A mounting device according to claim 1 wherein an aperture is provided in the base strip between each pair of head-forming elements.

4. A mounting device according to claim 3 wherein the aperture is elongate in the longitudinal direction of the strip.

* * * * *